United States Patent [19]

Kenworthy et al.

[11] Patent Number: 4,565,616

[45] Date of Patent: Jan. 21, 1986

[54] METHOD FOR PRODUCING A PHOTOELECTROFORMING MANDREL

[75] Inventors: James S. Kenworthy, Rockland; Thomas G. Kozinski, South Attleboro, both of Mass.

[73] Assignee: PPG Industries, Inc., Pittsburgh, Pa.

[21] Appl. No.: 730,414

[22] Filed: May 6, 1985

Related U.S. Application Data

[62] Division of Ser. No. 605,506, Apr. 30, 1984.

[51] Int. Cl.[4] ..... C23C 14/00

[52] U.S. Cl. ..... 204/192 C; 204/192 P

[58] Field of Search ..... 204/192 R, 192 C, 192 SP, 204/192 P

[56] References Cited

U.S. PATENT DOCUMENTS

| | | | |
|---|---|---|---|
| 947,224 | 5/1874 | Herrington et al. | 204/8 |
| 3,703,450 | 11/1972 | Bakewell | 204/11 |
| 3,833,482 | 9/1974 | Jacobus | 204/11 |
| 3,991,228 | 11/1976 | Carlson | 204/192 P |
| 4,113,599 | 9/1978 | Gillery | 204/192 C |
| 4,421,622 | 12/1983 | Hollars | 204/192 P |
| 4,512,864 | 4/1985 | Gillery | 204/192 P |

*Primary Examiner*—T. M. Tufariello

*Attorney, Agent, or Firm*—Donna L. Seidel

[57] ABSTRACT

The present invention relates to a method for producing an electroforming mandrel. The method comprises providing a substrate which transmits actinic radiation with a pattern which masks the transmission of actinic radiation, depositing on a surface of the patterned substrate a continuous conductive film which transmits actinic radiation depositing on the conductive film a continuous layer of a photoresist, exposing said photoresist to actinic radiation through said masking substrate and conductive film, and developing said photoresist to selectively remove a portion thereof in order to uncover a pattern of the underlying conductive film.

7 Claims, No Drawings

METHOD FOR PRODUCING A PHOTOELECTROFORMING MANDREL

This is a division of application Ser. No. 605,506, filed Apr. 30, 1984, pending.

BACKGROUND

The present invention relates generally to the art of electroplating, and more particularly to the art of electroforming on a patterned mandrel.

Electroforming of precision patterns, such as those used in optical systems, has been accomplished by several methods. For example, precision mesh patterns have been produced by electroplating onto a master pattern of lines formed by etching or ruling lines into a glass substrate and depositing a conductive material into the etched or ruled lines to form a conductive master pattern for electroplating. A major disadvantage of this method is the limitation on the fineness and precision of etching glass.

Photolithographic techniques have also been used to produce patterned electroforming mandrels. For example, a conductive substrate, such as a polished metal plate, is coated with a layer of photoresist. A patterned photomask is placed over the photoresist, which is then exposed to actinic radiation through the mask, thereby creating a pattern of exposed and unexposed photoresist which is further developed. Either the exposed or the unexposed portions of the photoresist are removed, depending on whether a positive or negative pattern is desired, resulting in a conductive pattern on the substrate. An electroplating process is then carried out to form a replica of the conductive pattern which can thereafter be removed from the substrate. This method is also restricted in the uniformity and precision of lines which can be formed, as well as requiring reprocessing of the master pattern after limited usage.

U.S. Pat. No. 3,703,450 to Bakewell discloses a method of fabricating precision conductive mesh patterns on a repetitively reusable master plate comprising a conductive pattern formed on a nonconductive substrate and a nonconductive pattern formed in the interstices of the conductive pattern. A reproduction of the master pattern is formed by plating of a conductive pattern onto the master pattern within a matrix defined by the nonconductive pattern. The conductive metal master pattern is typically deposited onto a glass plate by evaporation of a metal such as chromium through a ruled pattern formed on a stencil material. The nonconductive pattern is formed by depositing a layer of photoresist over the conductive pattern coated side of the glass plate. By exposing the photoresist to actinic radiation through the conductive pattern coated substrate, exact registeration of the conductive and nonconductive patterns is achieved. The photoresist layer is developed and the exposed portions are removed, leaving a pattern of photoresist over the conductive pattern. A silocon monoxide layer is then deposited over the entire surface of the glass plate, covering both the photoresist/conductive pattern coated portions and the exposed glass portions. Finally, the photoresist overlying the conductive pattern and the silicon monoxide overlying the residual photoresist material are removed, leaving the glass plate coated with a conductive metal pattern and an array of silicon monoxide deposits in the interstitial spaces in the conductive pattern. Replicas of the condutive pattern are then formed by electroplating.

SUMMARY OF THE INVENTION

The present invention provides an alternative process for producing an electroforming mandrel. A substrate transparent to actinic radiation is provided with a desired pattern for electroforming an article. The surface of the substrate is then coated with a continuous conductive film. A continuous layer of photoresist is deposited over the conductive film. The photoresist is exposed to actinic radiation through the substrate, the pattern acting to mask portions of the photoresist from exposure. The photoresist is then developed, and the unexpected portions removed to yield a conductive pattern of the underlying conductive film corresponding to the pattern on the substrate. Alternatively, the exposed portions of the photoresist may be removed to yield a conductive pattern which is a negative image of the pattern on the substrate. In other embodiments, either the exposed or unexposed photoresist may be removed and the conductive film in the areas underlying the removed photoresist may be etched away. Removing the remaining photoresist expose a pattern of the conductive film on the glass surface in either a positive or negative image of the pattern on the substrate. The resultant article is employed as a mandrel for the electroforming of metallic parts.

DETAILED DESCRIPTION OF THE PREFERRED EMBODIMENTS

In a preferred embodiment of the present invention, a glass plate is provided with a pattern representing the configuration of the article to be produced by electroforming. While the pattern may be formed by a coating, a most preferred embodiment of the present invention utilizes a glass photomask to provide the pattern, preferably a glass photomask having a pattern formed by stain producing metal infused into the glass. Preferred techniques for producing stained glass photomasks are described in detail in U.S. Pat. Nos. 4,144,066 and 4,155,735 to Ernsberger, the disclosures of which are incorporated herein by reference.

Preferably, a continuous, transparent conductive film is deposited on the stained surface of a stained glass photomask. The conductive film is preferably an electroconductive metal oxide such as tin oxide or indium oxide. The conductive film may be deposited by any conventional coating technique such as vacuum deposition, cathode sputtering, chemical vapor deposition or pyrolytic coating techniques. In a most preferred embodiment of the present invention, a conductive film comprising indium oxide is deposited by magnetron sputtering. The conductive film is preferably deposited on the stained surface of the photomask in order to optimize resolution of the pattern.

A continuous layer of photoresist is applied over the conductive film. Any conventional photoresist with sufficient resolution is acceptable. In a preferred embodiment of the present invention, photoresist in sheet form is laminated to the conductive film. The photoresist is exposed to actinic radiation through the glass plate and conductive film, which transmit sufficient radiation to cure the exposed portions of the photoresist. The photomask pattern masks portions of the photoresist from exposure, and these portions remain uncured. Following exposure of the photoresist, and a post-curing cycle if necessary, the photoresist is developed. Preferably, the photoresist is contacted with a chemical solution which dissolves and removes the unexposed, uncured portions of the photoresist, thereby providing a pattern of the underlying conductive film which is a positive image of the pattern in the glass photomask. The remaining exposed, cured portions of the photoresist surrounding the conductive pattern form walls within which the electroformed part is subsequently formed. In an alternative embodiment of the present invention a positive working photoresist may be employed to form a conductive film pattern which is a negative image of the photomask pattern.

The resulting article is employed as a mandrel for the electroforming of metallic parts replicating the pattern on the conductive film. In accordance with the present invention, the glass photomask substrate bearing a conductive film having a pattern defined by the photoresist is contacted with a conventional metal-containing electrodeposition solution. An electrical circuit is established, using the conductive film as the cathode and an electrode of the metal to be deposited as the anode. An electrical potential is applied, and metal is deposited on the conductive film in the pattern defined by the photoresist. Electrodeposition is continued until the desired thickness is obtained for the electroformed part. The glass photomask substrate bearing the conductive film, photoresist, and electroformed part is removed from the electrodeposition solution. Separation of the electroformed part from the photomask mandrel may be effected by various means such as alternately heating and chilling. If the part is thick enough, it may be stripped from the mandrel with the photoresist intact. In this embodiment, the mandrel is immediately reusable. However, in applications wherein the electroformed part is very thin and/or comprises a very fine lines, the remaining photoresist is first removed, preferably by dissolution. Then the electroformed part is lifted off the photomask mandrel. If the electroformed part is strong enough, it may be simply stripped from the conductive film. However, in most preferred embodiments of the present invention wherein the electroformed part comprises very fine lines, a preferred method for separating the electroformed part from the photomask mandrel is to contact the electroformed part with a tacky tape to which the part adheres, and to remove the part with the tape. The part if preferably removed from the tape by dissolution of the adhesive.

The present invention will be further understood from the descriptions of specific examples which follow.

EXAMPLE I

A glass photomask electroforming mandrel is prepared by coating a glass plate with a photographic emulsion comprising silver halide which is exposed to actinic radiation through a master pattern which defines the shape of the part to be electroformed. Exposed areas of the photographic emulsion form a latent image which is developed by immersion in developing solutions which convert the silver halide to colloidal silver. The coated glass plate is subjected to an electric field which induces migration of the silver ions into the glass. The silver ions are reduced to elemental silver which agglomerates into colloidal, microcrystalline color centers which form a stained pattern within the glass which corresponds with the master pattern of the article to be electroformed. The stained glass surface is then coated with a continuous conductive film by magnetron sputtering of a cathode comprising 90 percent indium and 10 percent tin. The preferred indium oxide film has a surface resistivity less than about 20 ohms per square. A continuous layer of photoresist is applied over the conductive film by laminating a sheet of photoresist to the indium oxide at a temperature of 235° F. (about 113° C.). A photoresist layer having a thickness of 0.001 inch (about 0.025 millimeter) is available from Thiokol/-Dynachem Corp. of Tustin, California. The photoresist is exposed to actinic radiation (Colight M-218) through the glass photomask for 20 seconds and cured. The photoresist is developed with a solvent which removes the unexposed portions of the photoresist thereby providing a pattern of the underlying indium oxide in the shape of the article to be electroformed. The resultant article is used as an electroforming mandrel in the following process.

EXAMPLE II

The glass photomask electroforming mandrel of Example I is prepared for electroforming by sequential dipping into a dilute solution of hydrochloric and nitric acids, and isopropanol, each followed by a water rinse to clean and wet the electroforming surface. The glass photomask is dipped into the electroforming solution several times to completely wet the surface and remove air bubbles before the electroforming process commences. The electroforming solution comprises nickel sulfamate, and is maintained at a temperature of 100° F. (about 43° C.). A cathode contact is applied to the indium oxide film of the glass photomask electroforming mandrel. An anode contact is applied to a depolarized nickel plate. Both the mandrel and the plate are immersed into the nickel sulfamate solution. At a current density of 10 amps per square foot, electroforming proceeds at a rate of 0.001 inch (0.025 millimeter) per 100 minutes. When the electroformed part reaches the desired thickness, the mandrel is removed from the solution, the remaining photoresist is dissolved and removed with sodium hydroxide solution, and the electroformed part is removed from the mandrel with tack tape.

The above examples are offered to illustrate the present invention. Various modifications are included within the scope of the present invention as defined by the following claims:

We claim:

1. A method for producing an electroforming mandrel comprising the steps of:

a. providing a substrate which transmits actinic radiation with a pattern which masks the transmission of actinic radiation;

b. depositing on a surface of the patterned substrate a continuous conductive film which transmits actinic radiation;

c. depositing on the conductive film a continuous layer of a photoresist;

d. exposing said photoresist to actinic radiation through said masking substrate and conductive film; and e. developing said photoresist to selectively remove a portion thereof in order to uncover a pattern of the underlying conductive film.

2. A method according to claim 1, wherin the substrate is glass.

3. A method according to claim 2, wherein the glass substrate is provided with a masking pattern by means of a stain pattern within the glass.

4. A method according to claim 3, wherein the conductive film is selected from the group consisting of indium oxide, tin oxide and mixtures thereof.

5. A method according to claim 4, wherein the conductive film is deposited by magnetron sputtering.

6. A method according to claim 5, wherein the photoresist is applied by laminating a sheet of photoresist to the conductive film.

7. A method according to claim 6, wherein the photoresist is developed by contacting it with a solvent which removes the uncured portions of the photoresist.

* * * * *